US011382198B2

(12) United States Patent
Galvano et al.

(10) Patent No.: US 11,382,198 B2
(45) Date of Patent: Jul. 5, 2022

(54) CIRCUIT FOR PROVIDING POWER TO TWO OR MORE STRINGS OF LEDS

(71) Applicant: Infineon Technologies AG, Neubiberg (DE)

(72) Inventors: Maurizio Galvano, Padua (IT); Alberto Trentin, Telve di Sopra (IT); Davide Ghedin, Fiesso d'artico (IT); Fabio Fragiacomo, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 3 days.

(21) Appl. No.: 16/898,057

(22) Filed: Jun. 10, 2020

(65) Prior Publication Data

US 2021/0392730 A1 Dec. 16, 2021

(51) Int. Cl.

| | |
|---|---|
| ***H05B 47/105*** | (2020.01) |
| ***H05B 45/14*** | (2020.01) |
| ***H05B 47/25*** | (2020.01) |
| ***H05B 45/52*** | (2020.01) |
| ***F21S 4/26*** | (2016.01) |
| *H05B 45/3725* | (2020.01) |

(Continued)

(52) U.S. Cl.

CPC ..... *H05B 45/52* (2020.01); *F21S 4/26* (2016.01); *H05B 45/14* (2020.01); *H05B 47/25* (2020.01); *F21Y 2103/10* (2016.08); *F21Y 2115/10* (2016.08); *H05B 45/3725* (2020.01)

(58) Field of Classification Search

CPC ..... F21S 4/26; H05B 45/52; H05B 45/14; H05B 45/3725; H05B 47/25; F21Y 2103/10; F21Y 2115/10

See application file for complete search history.

(56) References Cited

U.S. PATENT DOCUMENTS 9,203,311 B2 12/2015 Penzo et al.
9,763,296 B1 * 9/2017 Milanesi ..... H05B 45/46
(Continued)

FOREIGN PATENT DOCUMENTS

JP 2020045047 A * 3/2020 ..... H05B 45/48

OTHER PUBLICATIONS

Szolusha, "Single 2 MHz Buck-Boost Controller Drives Entire LED Headlight Cluster, Meets CISPR 25 Class 5 EMI," Analog Devices, 52-05, retrieved from https://www.analog.com/media/en/analog-dialogue/volume-52/number-2/single-2mhz-buck-boost-controller-drives-entire-led-headlight-cluster-meets-cispr25-class5-emi.pdf May 2018, 6 pp.

*Primary Examiner* — Henry Luong
(74) *Attorney, Agent, or Firm* — Shumaker & Sieffert, P.A.

(57) ABSTRACT

This disclosure includes systems, methods, and techniques for controlling delivery of power to one or more strings of light-emitting diodes (LEDs). For example, a circuit includes a power converter configured to generate an electrical current, a switching device, and a sensor. The sensor is configured to compare a magnitude of the electrical current to a threshold, and in response to the magnitude exceeding the threshold, cause the switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

23 Claims, 7 Drawing Sheets

(51) Int. Cl.
*F21Y 115/10* (2016.01)
*F21Y 103/10* (2016.01)

(56) References Cited

U.S. PATENT DOCUMENTS 10,420,178 B2 9/2019 Milanesi et al.
2018/0177013 A1* 6/2018 Weber ..... H05B 45/48

* cited by examiner

CIRCUIT FOR PROVIDING POWER TO TWO OR MORE STRINGS OF LEDS

TECHNICAL FIELD

This disclosure relates circuits for driving and controlling strings of light-emitting diodes.

BACKGROUND

Drivers are often used to control a voltage, current, or power at a load. For instance, a light-emitting diode (LED) driver may control the power supplied to a string of light-emitting diodes. Some drivers may include a Direct Current (DC) to DC power converter, such as a buck-boost, buck, boost, or another DC to DC converter. Such DC to DC power converters may be used to control and possibly change the power at the load based on a characteristic of the load. DC to DC power converters may be especially useful for regulating current through LED strings.

SUMMARY

In general, this disclosure is directed to devices, systems, and techniques for controlling an amount of electrical current delivered to one or more light-emitting diodes (LEDs). For example, a driver circuit may supply an electrical signal to the one or more LEDs. A controller may control the one or more LEDs in order to switch the one or more LEDs from a first lighting mode to a second lighting mode. In response to the controller switching from the first lighting mode to the second lighting mode, the driver circuit may cause a magnitude of the electrical signal to temporarily increase (e.g., "overshoot"). However, the driver circuit may sink at least a portion of the electrical signal in order to prevent the magnitude of the electrical signal from increasing above a maximum electrical signal magnitude value. This may prevent the overshoot of the electrical signal from damaging the one or more LEDs.

In some examples, a circuit is configured to control power delivered to a string of LEDs, the circuit including a power converter configured to generate an electrical current, a switching device, and a sensor. The sensor is configured to compare a magnitude of the electrical current to a threshold. In response to the magnitude exceeding the threshold, the sensor is configured to cause the switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

In some examples, a method for controlling power delivered to a string of LEDs includes generating, by a power converter, an electrical current and comparing, by a sensor, a magnitude of the electrical current to a threshold. In response to the magnitude exceeding the threshold, the method further includes causing, by the sensor, a switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

In some examples, a system includes a string of LEDs, a power converter configured to generate an electrical current, a switching device, and a sensor. The sensor is configured to compare a magnitude of the electrical current to a threshold. In response to the magnitude exceeding the threshold, the sensor is configured to cause the switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

The summary is intended to provide an overview of the subject matter described in this disclosure. It is not intended to provide an exclusive or exhaustive explanation of the systems, devices, and methods described in detail within the accompanying drawings and description below. Further details of one or more examples of this disclosure are set forth in the accompanying drawings and in the description below. Other features, objects, and advantages will be apparent from the description and drawings, and from the claims.

BRIEF DESCRIPTION OF DRAWINGS

Like reference characters denote like elements throughout the description and figures.

DETAILED DESCRIPTION

Some systems may use a power converter, such as a direct current (DC) to DC converter to control current supplied to a string of light emitting diodes (LEDs). This disclosure is directed to a circuit for controlling an amount of electrical current which travels from the power converter to the string of LEDs, such that an overshoot in the electrical current does not damage the string of LEDs. For example, the circuit may include a sink pathway configured to divert at least a portion of the electrical signal output from the power converter away from the string of LEDs. The sink pathway may include one or more switching devices which control whether the sink pathway diverts electrical current output from the power converter. In some cases, the circuit includes a current sensor which is configured to measure an electrical current magnitude along an electrical connection between the power converter and the string of LEDs. Based on the measured electrical current, the circuit may control the switching device in order to sink a portion of the electrical current output by the power converter.

Figure 1:
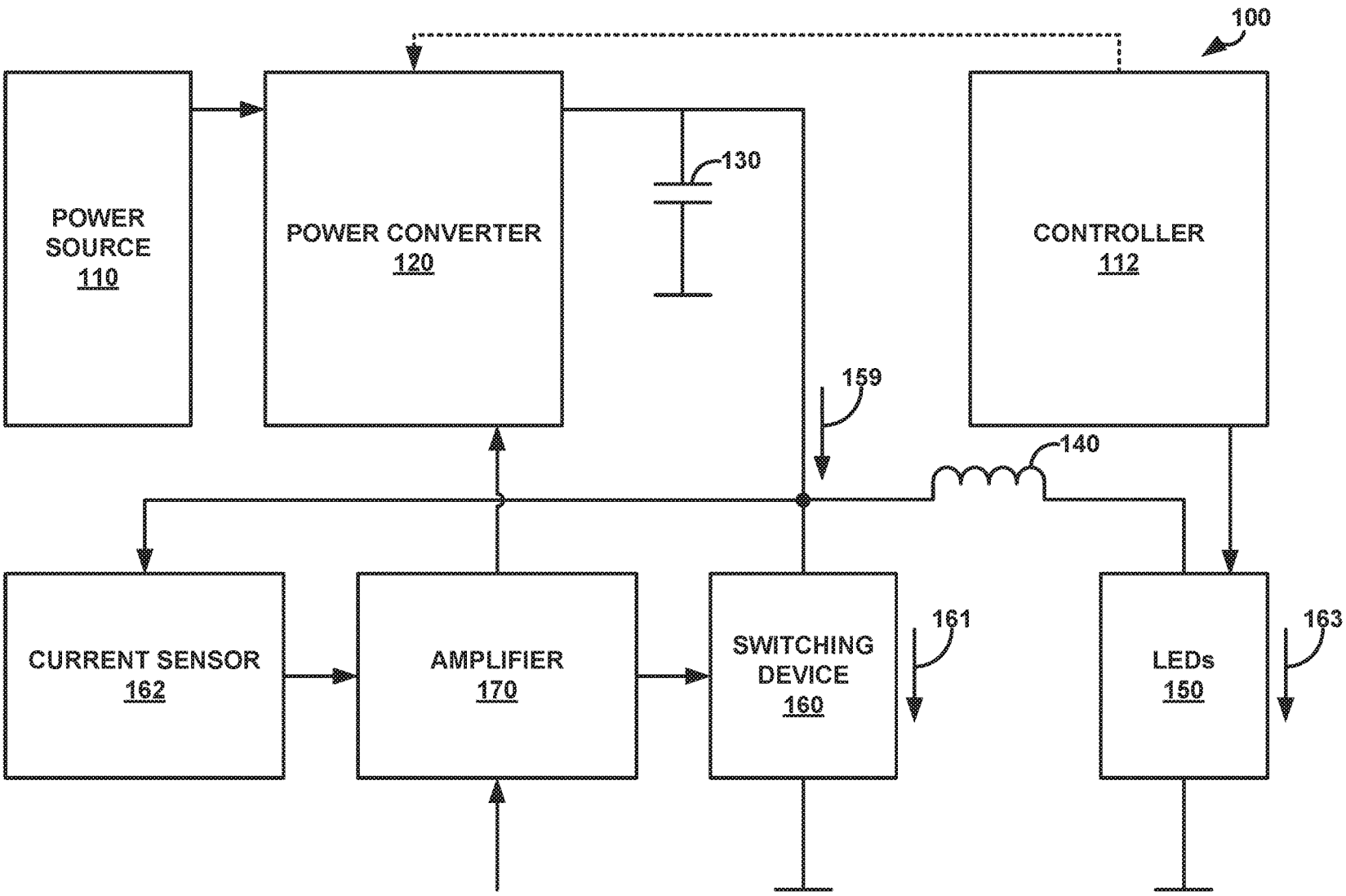
FIG. 1 is a block diagram illustrating an example system for controlling an electrical signal delivered from a power converter to a set of light-emitting diodes (LEDs), in accordance with one or more techniques of this disclosure.

FIG. 1 is a block diagram illustrating an example system 100 for controlling an electrical signal delivered from a power converter 120 to a set of LEDs 150, in accordance with one or more techniques of this disclosure. As seen in FIG. 1, system 100 includes a power source 110, a controller 112, power converter 120, a capacitor 130, an inductor 140, LEDs 150, switching device 160, current sensor 162, and amplifier 170.

System 100 may be configured to supply power to LEDs 150 in order to cause LEDs 150 to emit light. LEDs 150 may include one or more lighting modes, where each lighting mode of the one or more lighting modes requires a respective electrical signal. For example, the one or more lighting modes may include a low-light mode and a high-light mode. Switching LEDs 150 from the high-light mode to the low-light mode may include shorting at least one of LEDs 150 in order to decrease an amount of light emitted by LEDs 150. Shorting at least one of LEDs 150 may cause an overshoot of an electrical current delivered from power converter 120 to LEDs 150. System 100 may sink at least a portion of the electrical current delivered from power converter 120 to LEDs 150 in order to prevent LEDs 150 from being damaged by the electrical current.

Power source 110 is configured to deliver operating power to power converter 120. In some examples, power source 110 includes a battery and a power generation circuit to produce operating power. In some examples, power source 110 is rechargeable to allow extended operation. Power source 110 may include any one or more of a plurality of different battery types, such as nickel cadmium batteries and lithium ion batteries. In some examples, a maximum voltage output of power source 110 is approximately 12V. In some examples, power source 110 supplies power within a range from 5 Watts (W) to 50 W.

Controller 112 may include one or more processors that are configured to implement functionality and/or process instructions for execution within accelerometer system 10. For example, controller 112 may be capable of processing instructions stored in a memory. Controller 112 may include, for example, microprocessors, digital signal processors (DSPs), application specific integrated circuits (ASICs), field-programmable gate arrays (FPGAs), or equivalent discrete or integrated logic circuitry, or a combination of any of the foregoing devices or circuitry. Accordingly, controller 112 may include any suitable structure, whether in hardware, software, firmware, or any combination thereof, to perform the functions ascribed herein to controller 112.

A memory (not illustrated in FIG. 1) may be configured to store information within system 100 during operation. The memory may include a computer-readable storage medium or computer-readable storage device. In some examples, the memory includes one or more of a short-term memory or a long-term memory. The memory may include, for example, random access memories (RAM), dynamic random access memories (DRAM), static random access memories (SRAM), magnetic discs, optical discs, flash memories, or forms of electrically programmable memories (EPROM) or electrically erasable and programmable memories (EEPROM). In some examples, the memory is used to store program instructions for execution by controller 112.

Power source 110 may supply an input electrical signal to power converter 120. Furthermore, power converter 120 may provide at least a portion of an output electrical signal to first LEDs 150, which represent a load supplied with energy by power converter 120. The input electrical signal, in some cases, may include an input current and an input voltage. Additionally, the output electrical signal may include an output current and an output voltage. In some cases, power converter 120 includes a DC-to-DC power converter configured to regulate an electrical signal received by LEDs 150. In some examples, the DC-to-DC power converter includes a switch/inductor unit such as an H bridge. An H bridge uses a set of switches, often semiconductor switches, to convert electrical power. In some examples, the switch/inductor unit acts as a buck-boost converter. For instance, a buck-boost converter is configured to regulate the electrical signal received by LEDs 150 using at least two operational modes including a buck mode and a boost mode. Power converter 120 may control semiconductor switches of the buck-boost converter to alternate the mode of the buck-boost converter (e.g., change the operation mode of the buck-boost converter from buck mode to boost mode and vice versa).

In some examples, controller 112 is configured to output one or more signals in order to control power converter 120 to deliver a desired amount of electrical current to LEDs 150, but this is not required. In some examples, power converter 120 operates without receiving signals from controller 112. That is, power converter 120 is configured to operate independently from controller 112. It may be beneficial for power converter 120 to operate based on one or more signals received from amplifier 170 rather than operating based on one or more signals received from controller 112. In other words, power converter 120 may control an electrical current output from power converter 120 according to a feedback loop including current sensor 162 and amplifier 170. This may allow power converter 120 to control electrical current output from power converter 120 in real-time or near real-time based on an electrical current sensed by current sensor 162.

In the example illustrated in FIG. 1, the semiconductor switches of power converter 120 may include transistors, diodes, or other semiconductor elements. In buck mode, the buck-boost converter of power converter 120 may step down voltage and step up current from the input of power converter 120 to the output of power converter 120. In boost mode, the buck-boost converter of power converter 120 may step up voltage and step down current from the input of power converter 120 to the output of power converter 120. In some examples, power converter 120 is configured to regulate a current of the electrical signal received by LEDs 150 such that a current of the electrical signal remains substantially constant.

In some examples, power converter 120 may supply power to LEDs 150 using capacitor 130. Capacitor 130 is an electrical circuit component configured for storing electric potential energy. Capacitor 130 may, in some examples, occupy a "charged" state, where capacitor 130 stores an amount of electric potential energy. Additionally, capacitor 130 may occupy a "discharged" state where capacitor 130 stores little or no electric potential energy. Capacitor 130 may also transition between the charged state and the discharged state. When capacitor 130 is charging, a current flows across capacitor 130, increasing the electric potential energy stored by capacitor 130. When capacitor 130 is discharging, the electric potential energy stored by capacitor 130 is released, causing capacitor 130 to emit an electric current.

Capacitor 130 may represent an output capacitor for power converter 120. For example, power converter 120 may charge and discharge capacitor 130 in cycles so that a discharge of capacitor 130 delivers a desired amount of electrical current to LEDs 150. For example, when LEDs 150 are operating in a high-light mode, power converter 120 may charge capacitor 130 to a first charge level and when LEDs 150 are operating in a low-light mode, power converter 120 may charge capacitor 130 to a second charge level, where the first charge level is greater than the second charge level. When controller 112 toggles LEDs 150 from the high-light mode to the low-light mode, however, power converter 120 might not be able to instantly change an amount of charge in capacitor 130. As such, if capacitor 130 discharges shortly after controller 112 toggles LEDs 150 from the high-light mode to the low-light mode, the electrical current received by LEDs 150 in response to the discharge of capacitor 130 may represent an overshoot electrical current. System 100 may sink at least a portion of the overshoot electrical current in order to prevent the overshoot electrical current from damaging LEDs 150.

Inductor 140 may be electrically connected to LEDs 150 such that LEDs 150 receive the electrical signal from power converter 120 through inductor 140. Inductor 140 represents an electrical circuit component that resists change in a magnitude of electrical current passing through inductor 140. In some examples, inductor 140 is defined by an electrically conductive wire that is wrapped in a coil. As electrical current passes through the coil of inductor 140, a magnetic field is created in the coil, and the magnetic field induces a voltage across the inductor. Inductor 140 defines an inductance value, and the inductance value is the ratio of the voltage across inductor 140 to the rate of change of current passing through inductor 140.

Inductor 140 may act to mitigate an overshoot of the electrical current received by LEDs 150. For example, since inductor 140 resists a change in the magnitude of the electrical current flowing through 140, inductor 140 may prevent the electrical current received by LEDs 150 from increasing as sharply during an electrical current overshoot as compared with a system where LEDs receive an electrical signal directly from a power converter without receiving the electrical signal through an inductor. Inductor 140 alone, however, might not be able to prevent an overshoot electrical current from damaging LEDs 150. System 100 may sink a portion of an overshoot electrical current through switching device 180 in order to prevent the overshoot electrical current from damaging LEDs 150.

Although FIG. 1 illustrates inductor 140 as being a part of system 100, in some cases, system 100 might not include an inductor 140 electrically connected to LEDs 150. In some examples, amplifier 170 generates the amplifier signal to control power converter 120 and/or switching device 160 in order to prevent electrical current 159 from damaging LEDs 150 during a current overshoot without relying on an inductor to mitigate the current overshoot. In other words, system 100 may be configured to perform one or more techniques described herein without inductor 140.

LEDs 150 may include any one or more suitable semiconductor light sources. In some examples, an LED of LEDs 150 may include a p-n junction configured to emit light when activated. In some examples, LEDs 150 may be included in a headlight assembly for automotive applications. For instance, LEDs 150 may include a matrix, a string, or more than one string of light-emitting diodes to light a road ahead of a vehicle. As used herein, a vehicle may refer to motorcycles, trucks, boats, golf carts, snowmobiles, heavy machines, or any type of vehicle that uses directional lighting. In some examples, LEDs 150 include a first string of LEDs including a set of high-beam (HB) LEDs and a set of low-beam (LB) LEDs. In some cases, controller 112 may toggle between activating the set of LB LEDs, activating the set of HB LEDs, activating both the set of LB LEDs and the set of HB LEDs, and deactivating both the set of LB LEDs and the set of HB LEDs. LEDs 150 may include any number of LEDs. For example, LEDs 150 may include a number of LEDs within a range from 1 to 100 LEDs. In some examples, a high-light mode of LEDs 150 may represent a mode in which the set of HB LEDs are activated. In some examples, a low-light mode of LEDs 150 may represent a mode in which the set of HB LEDs are not activated.

It may be beneficial for system 100 to sink at least a portion of an overshoot electrical current through switching device 160. For example, an overshoot electrical current may cause switching device 160 to activate, causing an undesired electrical current 161 to flow through switching device 160 and allowing a desired electrical current 163 to flow through LEDs 150. By activating switching device 160 in order to sink the undesired electrical current 161, system 100 may prevent the current flowing through LEDs 150 from damaging LEDs 150. In other words, switching device 160 may ensure that only the desired electrical current 163 flows through LEDs 150, where the desired electrical current 163 does not damage the LEDs 150.

Switching device 160 may, in some cases, include a power switch such as, but not limited to, any type of field-effect transistor (FET) including any combination of a metal-oxide-semiconductor field-effect transistor (MOSFET), a bipolar junction transistors (BJT), an insulated-gate bipolar transistor (IGBT), a junction field effect transistors (JFET), a high electron mobility transistor (HEMT), or other elements that use voltage and/or current for control. Additionally, switching device 160 may include n-type transistors, p-type transistors, and power transistors, or any combination thereof. In some examples, switching device 160 includes vertical transistors, lateral transistors, and/or horizontal transistors. In some examples, switching device 160 include other analog devices such as diodes and/or thyristors. In some examples, switching device 160 may operate as switches and/or as analog devices.

In some examples, switching device 160 includes three terminals: two load terminals and a control terminal. For MOSFET switches, switching device 160 may include a drain terminal, a source terminal, and at least one gate terminal, where the control terminal is a gate terminal. For BJT switches, the control terminal may be a base terminal. Current may flow between the two load terminals of switching device 160, based on the voltage at the respective control terminal. Therefore, electrical current may flow across switching device 160 based on control signals delivered to the control terminal of switching device 160. In one example, if a voltage applied to the control terminal of switching device 160 is greater than or equal to a voltage threshold, switching device 160 may be activated, allowing switching device 160 to conduct electricity. Furthermore, switching device 160 may be deactivated when the voltage applied to the control terminal of switching device 160 is below the threshold voltage, thus preventing switching device 160 from conducting electricity.

Switching device 160 may include various material compounds, such as Silicon, Silicon Carbide, Gallium Nitride, or any other combination of one or more semiconductor materials. In some examples, silicon carbide switches may experience lower switching power losses. Improvements in magnetics and faster switching, such as Gallium Nitride switches, may allow switching device 160 to draw short bursts of current from power converter 120. These higher frequency switching devices may require control signals to be sent with more precise timing, as compared to lower-frequency switching devices.

System 100 may control whether switching device 160 is activated based on an electrical current sensed by current sensor 162. In some examples, current sensor 162 includes a current sensing resistor (not illustrated in FIG. 1) and a current sensing amplifier (not illustrated in FIG. 1). Ohm's law dictates that a voltage across a resistor is equal to a resistance of the resistor times a magnitude of a current across the resistor (V=I*R). As such, a current across the current sensing resistor is equal to a voltage across the current sensing resistor divided by a resistance value (in ohms (a)) of the current sensing resistor. The current sensing amplifier, in some cases, may output a current sensor signal correlated with a current across the current sensing resistor. As such, the current sensing amplifier may output the current sensor signal correlated with a current sensed by current sensor 162.

Amplifier 170 may be configured to receive the current sensor signal from current sensor 162. The current sensor signal may represent an electrical signal which includes a current sensor signal electrical voltage and a current sensor signal electrical current. In some examples, the current sensor signal electrical voltage is correlated with an electrical current sensed by current sensor 162. In some examples, the current sensor signal electrical current is correlated with an electrical current sensed by current sensor 162. In any case, the current sensor signal indicates a magnitude of the electrical current measured by current sensor 162.

Amplifier 170 may receive a control signal. The control signal may represent an electrical signal which includes a control signal voltage and a control signal current. Based on the current sensor signal and the control signal, amplifier 170 may generate an amplifier signal for controlling whether switching device 160 is turned on or turned off. The control signal may include information indicative of one or more thresholds for the current sensor signal. For example, the control signal may include information indicative of a maximum current sensor signal value. The amplifier 170 may control the switching device 160 to be turned on when a current sensor signal value is greater than the maximum current sensor signal value. The amplifier 170 may control the switching device 160 to be turned off when a current sensor signal value is not greater than the maximum current sensor signal value. The maximum current sensor signal value may represent one or both of a maximum current sensor signal electrical voltage or a maximum current sensor signal electrical current.

In some examples, the control signal received by amplifier 170 may include information indicative of a lower-bound current sensor signal value and an upper-bound current sensor signal. Amplifier 170 may generate the amplifier signal in order to turn on switching device 160 when the current sensor signal increases to the upper-bound current sensor signal value, causing the current sensor signal to decrease from the upper-bound current sensor signal value. In other words, amplifier 170 may be configured to control switching device 160 to sink an undesired electrical current 161 during a current overshoot, thus preventing the current overshoot from damaging LEDs 150. Amplifier 170 may generate the amplifier signal in order to turn off switching device 160 when the current sensor signal decreases to the lower-bound current sensor signal value. In other words, if the current sensor signal increases past a baseline value, indicating a current overshoot to LEDs 150, amplifier 170 may generate the amplifier signal in order to maintain the current sensor signal between the lower-bound current sensor signal value and the upper-bound current sensor signal value. This, in turn, may ensure that the electrical current received by LEDs 150 during a current overshoot does not exceed a level which is harmful to LEDs 150.

Additionally, or alternatively, amplifier 170 may also output the amplifier signal to power converter 120. For example, power converter 120 may control an amount of electrical current output to LEDs 150. Based on the amplifier signal, power converter 120 may adjust an amount of electrical current output from power converter 120 such that the amount of electrical current received by LEDs 150 does not damage LEDs 150. For example, amplifier 170 may be configured to control power converter 120 to decrease an amount of electrical current output by power converter 120 in response to current sensor 162 detecting a current overshoot, thus preventing the current overshoot from damaging LEDs 150. Amplifier 170 may output the amplifier signal in order to control a duty cycle of the one or more switching devices of power converter 120. The amplifier signal may, in some cases, define on/off switching of one or more switching devices of power converter 120, thereby causing power converter 120 to deliver the desired amount of electrical current to LEDs 150. Increasing the duty cycle of the one or more switching devices may increase the electrical current delivered to LEDs 150. Decreasing the duty cycle of the one or more switching devices may decrease the electrical current delivered to LEDs 150.

Power converter 120 and/or capacitor 130 outputs electrical current 159. When switching device 160 is activated, electrical current 159 may be split into the undesired electrical current 161 which flows through switching device 160 to ground and the desired electrical current 163 which flows through LEDs 150 to ground. During a current overshoot, a magnitude of electrical current 159 may be great enough to damage LEDs 150 if a full burden of electrical current 159 were to reach LEDs 150. By turning on switching device 160, amplifier 170 may split electrical current 159 into undesired electrical current 161 and desired electrical current 163. This may cause undesired electrical current 161, which is a portion of electrical current 159, to flow through switching device 160 rather than flow through 150 and allow desired electrical current 163 to flow through LEDs 150. While switching device 160 is turned on, a magnitude of desired electrical current 163 may be lower than a magnitude of electrical current 159 such that desired electrical current 163 does not cause damage to LEDs 150. In other words, by preventing undesired electrical current 161 from reaching LEDs 150, amplifier 170 may prevent a full force of electrical current 159 from damaging LEDs 160 during a current overshoot.

A current overshoot may occur when controller 112 outputs a control signal in order to short a path across a first set of LEDs of LEDs 150, causing the first set of LEDs to turn off while a second set of LEDs of LEDs 150 remain turned on. By shorting the path across the first set of LEDs, controller 112 may remove the first set of LEDs from an electrical pathway between power converter 120 and ground. As such, shorting the path across the first set of LEDs may decrease a resistance of LEDs 150, thus increasing the magnitude of electrical current 159 output from power converter 120 and/or capacitor 130. Current sensor 162 may detect the current overshot by detecting the increase in electrical current 159, and amplifier 170 may activate switching device 160 to sink the undesired electrical current 161, preventing LEDs 150 from being damaged. In some examples, controller 112 may short a path across the first set of LEDs of LEDs 150 in response to receiving an instruction to toggle LEDs 150 from a high beam mode to a low beam mode.

A current overshoot may occur for one or more other reasons not described herein. For example, a current overshoot may represent any scenario in which electrical current 159 increases to a magnitude which may potentially harm LEDs 150. Current sensor 162 may generate the current sensor signal in order to indicate a current overshoot, and amplifier 170 may control power converter 120 and/or switching device 160 in order to prevent the current overshoot from damaging LEDs 150.

Figure 2:
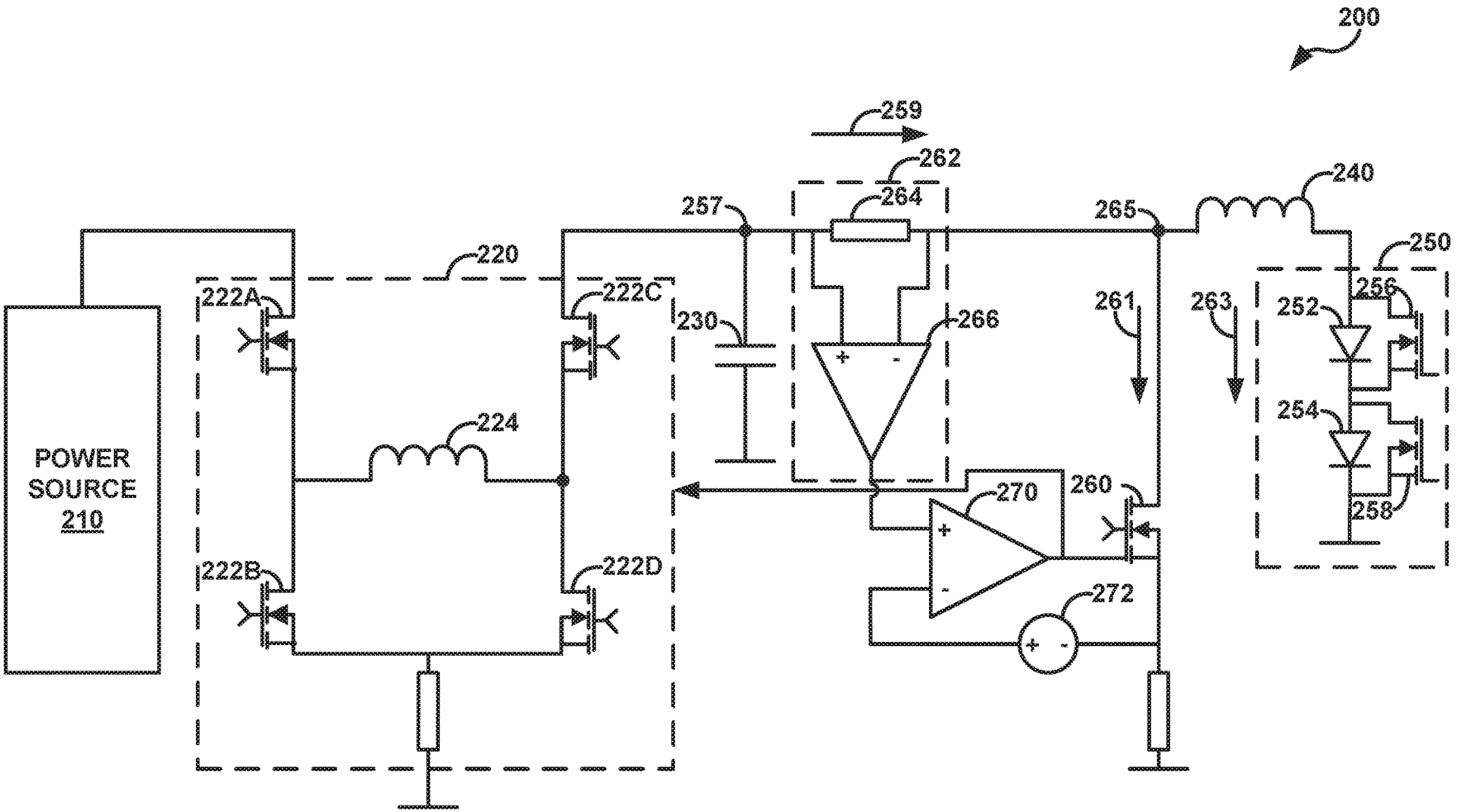
FIG. 2 is a circuit diagram illustrating a system including a circuit for controlling power to a set of LEDs using a switching device, in accordance with one or more techniques of this disclosure.

FIG. 2 is a circuit diagram illustrating a system 200 including a circuit for controlling power to a set of LEDs 250 using a switching device 260, in accordance with one or more techniques of this disclosure. As illustrated in FIG. 2, system 200 includes power source 210, power converter 220, capacitor 230, inductor 240, LEDs 250, current sensor 262, and amplifier 270. Power converter 220 includes switching devices 222A-222D (collectively, "switching devices 222") and inductor 224. LEDs 250 include a first set of LEDs 252, a second set of LEDs 254, a first set of LED switching devices 256, and a second set of LED switching devices 258. Current sensor 262 includes current sensing resistor 264 and current sensing amplifier 266. Amplifier control signal unit 272 may provide an amplifier control signal to amplifier 270. Power source 210 may be an example of power source 110 of FIG. 1. Power converter 220 may be an example of power converter 120 of FIG. 1. Capacitor 230 may be an example of capacitor 130 of FIG. 1. Inductor 240 may be an example of inductor 140 of FIG. 1. LEDs 250 may be an example of LEDs 150 of FIG. 1. Switching device 260 may be an example of switching device 160 of FIG. 1. Current sensor 262 may be an example of current sensor 162 of FIG. 1. Amplifier 270 may be an example of amplifier 170 of FIG. 1. In some examples, system 200 may be configured to perform one or more techniques described herein without inductor 240.

Power source 210 may supply an input signal to power converter 220. Power converter 220 may include a switch/inductor unit that acts as a synchronous boost converter (e.g., an H-bridge). The H-bridge may be represented by switching devices 222 and inductor 224. Each of switching devices 222 may, in some cases, include power switches such as, but not limited to, any type of FET including any combination of MOSFETs, BJTs, IGBTs, JFETs, HEMTs, or other elements that use voltage for control. Additionally, switching devices 222 may include n-type transistors, p-type transistors, and power transistors, or any combination thereof. In some examples, switching devices 222 include vertical transistors, lateral transistors, and/or horizontal transistors. In some examples, switching devices 222 include other analog devices such as diodes and/or thyristors. In some examples, switching devices 222 may operate as switches and/or as analog devices.

In some examples, each of switching devices 222 include three terminals: two load terminals and a control terminal. For MOSFET switches, each of switching devices 222 may include a drain terminal, a source terminal, and at least one gate terminal, where the control terminal is a gate terminal. For BJT switches, the control terminal may be a base terminal. Current may flow between the two load terminals of each of switching devices 222, based on the voltage at the respective control terminal. Therefore, electrical current may flow across switching devices 222 based on control signals delivered to the respective control terminals of switching devices 222. In one example, if a voltage applied to the control terminals of switching devices 222 is greater than or equal to a voltage threshold, switching devices 222 may be activated, allowing switching devices 222 to conduct electricity. Furthermore, switching devices 222 may be deactivated when the voltage applied to the respective control terminals of switching devices 222 is below the threshold voltage, thus preventing switching devices 222 from conducting electricity. A controller, e.g., controller 112 of FIG. 1, may be configured to independently control switching devices 222 such that one, a combination, all, or none of switching devices 222 may be activated at a point in time.

Switching devices 222 may include various material compounds, such as Silicon, Silicon Carbide, Gallium Nitride, or any other combination of one or more semiconductor materials. In some examples, silicon carbide switches may experience lower switching power losses. Improvements in magnetics and faster switching, such as Gallium Nitride switches, may allow switching devices 222 to draw short bursts of current from power source 210. These higher frequency switching devices may require control signals (e.g., voltage signals delivered by a controller (not illustrated in FIG. 2) to respective control terminals of switching devices 222) to be sent with more precise timing, as compared to lower-frequency switching devices.

Inductor 224 may represent a component of power converter 220 according to the example illustrated in FIG. 2. When inductor 224 is charged with a magnetic field and placed in series with power source 210 and LEDs 250, the voltage across inductor 224 is configured to boost the magnitude of the output voltage delivered to LEDs 250.

In some examples, a switch/inductor unit (e.g., switching devices 222 and inductor 224) may be configured to regulate the output voltage delivered to LEDs 250 using at least one operational mode including a boost mode. In the example illustrated in FIG. 2, switching devices 222 may include transistors, diodes, or other semiconductor elements. In boost mode, the switch/inductor unit may step up voltage and step down current from the input of power converter 220 to the output of power converter 220. As such, power converter 220 may accept an input signal from power source 210 and generate a power converter output signal. The power converter output signal may include a power converter output voltage and a power converter output current, where the power converter output voltage is greater than a voltage of the input signal and the power converter output current is less than a current of the input signal when power converter 220 is in the boost mode.

In some examples, while the switch/inductor unit is in boost mode, switching device 222A is activated, switching device 222B is deactivated, and switching device 222D alternates between being activated and being deactivated. When switching device 222D is activated, an electrical current flows from power source 210 through switching device 222A, inductor 224, and switching device 222D, charging inductor 224. When switching device 222D is deactivated, inductor 224 discharges and an electrical current flows from power source 210 through switching device 222A, inductor 224, and switching device 222C, thus stepping up (e.g., boosting) an output voltage of the power converter output signal. Additionally, during boost mode, power converter 220 may step down a current of the power converter output signal.

Capacitor 230 may represent an output capacitor for power converter 220. For example, capacitor 230 may charge to a charge level based on one or more cycles of power converter 220. Power converter 220 may charge capacitor 230 based on a desired amount of electrical current for supply to LEDs 250. For example, when LEDs 250 are operating in a high-light mode, it may be beneficial for LEDs 250 to receive a first amount of current. When LEDs 250 are operating in a low-light mode, it may be beneficial for LEDs 250 to receive a second amount of current which is lower than the first amount of current. A controller (e.g., controller 112 of FIG. 1) may switch LEDs 250 from the high-light mode to the low-light mode. This may cause a temporary surge (e.g., "overshoot") in the electrical current 259 output from power converter 220 and/or capacitor 230. Additionally, or alternatively, one or more other factors may cause an overshoot in the electrical current 259.

Current sensor 262 may be configured to generate a current sensor signal which indicates a magnitude of electrical current 259. That is, current sensor 262 may be configured to generate the current sensor signal to indicate the magnitude of the electrical current flowing from node 257 to node 265. In some examples, current sensor 262 includes current sensing resistor 264 and current sensing amplifier 266. Ohm's law defines that a voltage across a resistor is equal to a resistance of the resistor times a magnitude of a current across the resistor (V=I*R). As such, a current across current sensing resistor 264 is equal to a voltage across current sensing resistor 264 divided by a resistance value (in ohms (a)) of current sensing resistor 264. Current sensing amplifier 266, in some cases, may output a current sensor signal correlated with a current across current sensing resistor 264. As such, current sensing amplifier 266 may output the current sensor signal correlated with a current sensed by current sensor 162.

Current sensor 262 outputs the current sensor signal to amplifier 270. Additionally, amplifier 270 receives a control signal from control signal unit 272. In turn, amplifier 270 generates an amplifier signal for output to a control terminal of switching device 260. In some examples, amplifier 270 may generate the amplifier signal based on whether a magnitude of the current sensor signal is greater than or equal to a maximum parameter value indicated by the control signal. If the magnitude of the current sensor signal is greater than or equal to the maximum parameter value, amplifier 270 may generate the amplifier signal to turn on switching device 260. If the magnitude of the current sensor signal is not greater than or equal to the maximum parameter value, amplifier 270 may generate the amplifier signal to turn off switching device 260.

When switching device 260 is turned on, electrical current 259 may be divided into undesired electrical current 261 which flows through switching device 260 and desired electrical current 263 which flows through LEDs 250. In other words, switching device 260 "sinks" the undesired electrical current 261 so that the undesired electrical current 261 does not reach LEDs 250. When switching device 260 is turned off, a magnitude of the undesired electrical current 261 may be zero or near-zero. This means that a magnitude of desired electrical current 263 may be the same as the magnitude of electrical current 259 when switching device 260 is turned off.

Amplifier 270 may, in some cases, output the amplifier signal to power converter 220. As such, amplifier 270 may control one or more aspects of the operation of power converter 220. For example, the amplifier signal may control a duty cycle of one or more of switching devices 222 of power converter 220, thus controlling a magnitude of electrical current 259. For example, decreasing a duty cycle of one or more of switching devices 222 may cause the magnitude of electrical current 259 to decrease and increasing the duty cycle of one or more of switching devices 222 may cause the magnitude of electrical current 259 to increase. In some examples, the amplifier signal may control a switching mode (e.g., boost mode or buck mode) which power converter 220 operates according to. In some examples, the amplifier signal may control one or more other aspect of the operation of power converter 220.

In some examples, a controller may short the first set of LEDs 252 by turning on the first set of LED switching devices 256. In some examples, the controller may short the second set of LEDs 254 by turning on the second set of LED switching devices 258. Shorting one or both of the first set of LEDs 252 or the second set of LEDs 254 may cause an overshoot in electrical current 259. Current sensor 262 may generate the current sensor signal in order to indicate the current overshoot, and amplifier 270—may sink the undesired electrical current 161 in response to receiving the current sensor signal indicating the current overshoot, preventing the current overshoot from damaging LEDs 250. In some examples, the controller shorts the path across the first set of LEDs 252 in response to receiving an instruction to toggle the string of LEDs from a high beam mode to a low beam mode.

Figure 3:
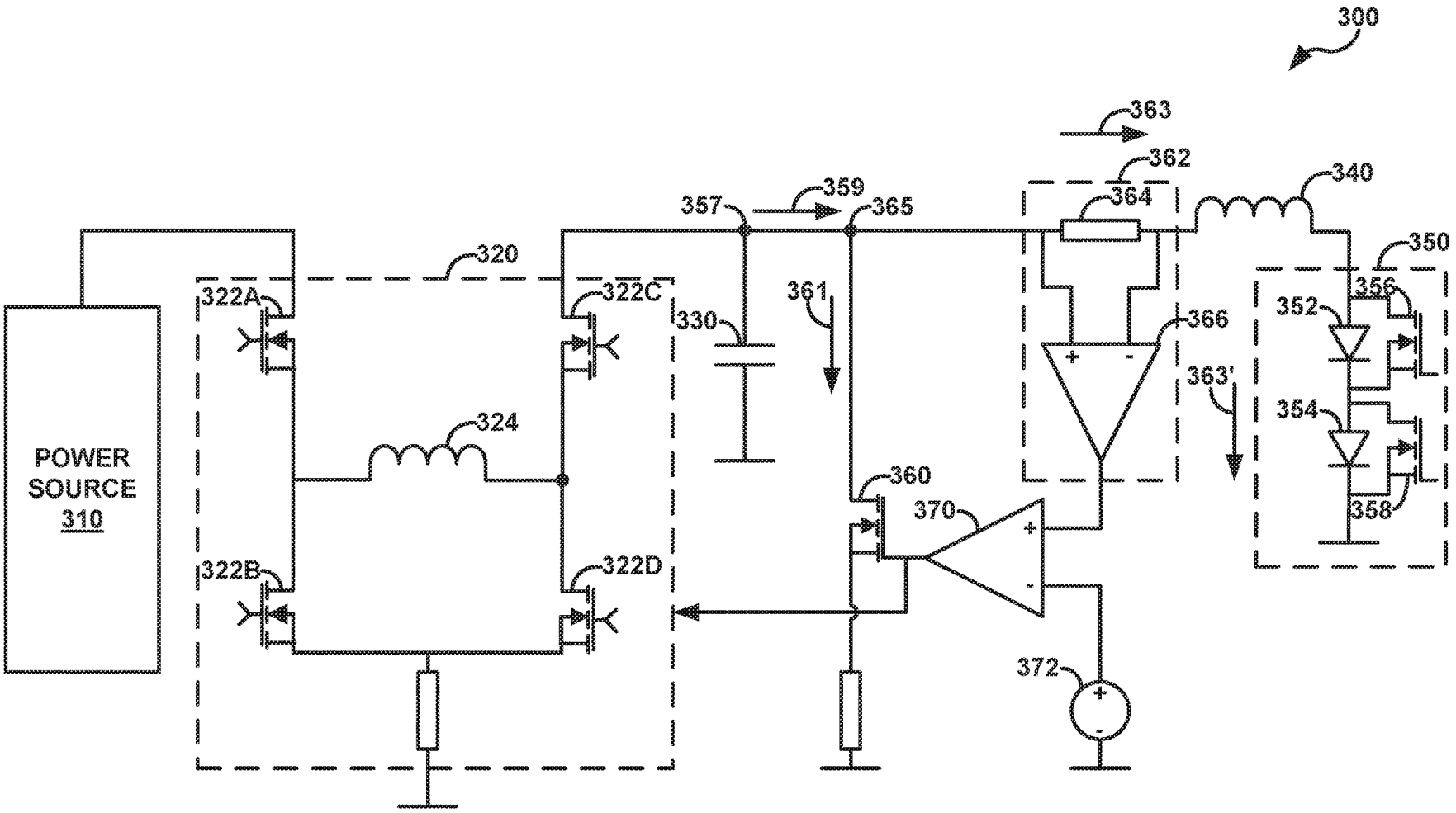
FIG. 3 is a circuit diagram illustrating a system including a circuit for controlling power to a set of LEDs by controlling a switching device and controlling a power converter, in accordance with one or more techniques of this disclosure.

FIG. 3 is a circuit diagram illustrating a system 300 including a circuit for controlling power to a set of LEDs 350 by controlling a switching device 260 and controlling a power converter 320, in accordance with one or more techniques of this disclosure. As illustrated in FIG. 3, system 300 includes power source 310, power converter 320, capacitor 330, inductor 340, LEDs 350, current sensor 362, and amplifier 370. Power converter 320 includes switching devices 322A-322D (collectively, "switching devices 322") and inductor 324. LEDs 350 include a first set of LEDs 352, a second set of LEDs 354, a first set of LED switching devices 356, and a second set of LED switching devices 358. Current sensor 362 includes current sensing resistor 364 and current sensing amplifier 366. Amplifier control signal unit 372 may provide an amplifier control signal to amplifier 370. Power source 310 may be an example of power source 110 of FIG. 1. Power converter 320 may be an example of power converter 120 of FIG. 1. Capacitor 330 may be an example of capacitor 130 of FIG. 1. Inductor 340 may be an example of inductor 140 of FIG. 1. LEDs 350 may be an example of LEDs 150 of FIG. 1. Switching device 360 may be an example of switching device 160 of FIG. 1. Current sensor 362 may be an example of current sensor 162 of FIG. 1. Amplifier 370 may be an example of amplifier 170 of FIG. 1. In some examples, system 300 may be configured to perform one or more techniques described herein without inductor 340.

The system 300 of FIG. 3 may be substantially the same as the system 200 of FIG. 2, except that switching device 360, current sensor 362, amplifier 370, and amplifier control signal unit 372 are placed in a configuration such that node 365 emits undesired electrical current 361 which flows through switching device 360 and emits desired electrical current 363 which is sensed by current sensor 362. System 200 of FIG. 2, on the other hand, includes a current sensor 262 which senses an electrical current 259 flowing into a node 265, where undesired electrical current 261 and desired electrical current 263 flow from node 265.

In some examples, power converter 320 and capacitor 330 may cause node 357 to emit electrical current 359. Electrical current 359 may flow through an electrical conductor from node 357 to node 365. In some examples, node 357 and node 365 may be classified as one electrical node, since there are no electrical circuit elements between node 357 and node 365, meaning that node 357 and node 365 have the same voltage. In some examples, node 365 emits undesired electrical current 361 and desired electrical current 363 when switching device 360 is turned on, meaning that switching device 360 is configured to create an electrical pathway from node 365 to ground when switching device 360 is turned on, causing electrical current 359 to split into undesired electrical current 361 and desired electrical current 363. When switching device 360 is turned off, there may be no electrical pathway from node 365 to ground through switching device 360. This means that a magnitude of desired electrical current 363 may be substantially the same as a magnitude of electrical current 359 and a magnitude of undesired electrical current 361 may be zero when switching device 360 is turned off.

Current sensor 362 may be configured to generate a current sensor signal which indicates a magnitude of desired electrical current 363. That is, current sensor 362 may be configured to generate the current sensor signal to indicate the magnitude of the electrical current flowing from node 365 to inductor 340. In some examples, current sensor 362 includes current sensing resistor 364 and current sensing amplifier 366. Ohm's law dictates that a voltage across a resistor is equal to a resistance of the resistor times a magnitude of a current across the resistor (V=I*R). As such, a current across current sensing resistor 364 is equal to a voltage across current sensing resistor 364 divided by a resistance value (in ohms (a)) of current sensing resistor 364. Current sensing amplifier 366, in some cases, may output a current sensor signal correlated with a current across current sensing resistor 364. As such, current sensing amplifier 366 may output the current sensor signal correlated with a current sensed by current sensor 362.

Current sensor 362 outputs the current sensor signal to amplifier 370. Additionally, amplifier 370 receives a control signal from control signal unit 372. In turn, amplifier 370 generates an amplifier signal for output to a control terminal of switching device 360. Additionally, amplifier 370 outputs the amplified signal to power converter 320. In some examples, amplifier 370 may generate the amplifier signal based on a comparison of the current sensor signal to one or more thresholds indicated by the control signal. For example, the control signal may include an upper-bound overshoot current threshold and a lower-bound overshoot current threshold.

When a magnitude of the current sensor signal generated by current sensor 362 increases to the upper-bound overshoot current threshold, amplifier 370 may generate the amplifier signal to turn on switching device 360, thus sinking undesired electrical current 361 to ground and preventing electrical current 359 from damaging LEDs 350 when electrical current 359 represents an overshoot current. By turning on switching device 360 and sinking the undesired electrical current 361, amplifier 370 may cause desired electrical current 363 to decrease, thus decreasing the current sensor signal generated by current sensor 362. When the current sensor signal decreases to the lower-bound overshoot current threshold from the upper-bound overshoot current threshold, amplifier 370 may generate the amplifier signal in order to turn off switching device 360. This means that there is no longer an electrical pathway from node 365 to ground through switching device 360, and desired electrical current 363 increases, causing the current sensor signal to increase. In some examples, the current sensor signal increases from the lower-bound overshoot current threshold to the upper-bound overshoot current threshold in response to amplifier 370 turning off the switching device 360. Responsive to the current sensor signal increasing from the lower-bound overshoot current threshold to the upper-bound overshoot current threshold, amplifier 370 may generate the amplifier signal to turn on switching device 360 once again, causing desired electrical current 363 to decrease and preventing electrical current 359 from damaging LEDs 350 when electrical current 359 represents an overshoot current.

In some examples, electrical current 359 settles to a baseline electrical current value following an overshoot of electrical current 359. When electrical current 359 represents a baseline electrical current value, a magnitude of desired electrical current 363 may be low enough such that current sensor 362 and amplifier 370 do not turn on switching device 360 to sink undesired electrical current 361.

Amplifier 370 may, in some cases, output the amplifier signal to power converter 320. As such, amplifier 370 may control one or more aspects of the operation of power converter 320. For example, the amplifier signal may control a duty cycle of one or more of switching devices 322 of power converter 320, thus controlling a magnitude of electrical current 359. For example, decreasing a duty cycle of one or more of switching devices 322 may cause the magnitude of electrical current 359 to decrease and increasing the duty cycle of one or more of switching devices 322 may cause the magnitude of electrical current 359 to increase. In some examples, the amplifier signal may control a switching mode (e.g., boost mode or buck mode) which power converter 320 operates according to. In some examples, the amplifier signal may control one or more other aspect of the operation of power converter 320.

Desired electrical current 363' may be substantially the same as desired electrical current 363 except that desired electrical current 363' represents the current on an opposite side of inductor 340 as desired electrical current 363. When inductor 340 is fully charged, a magnitude of the desired electrical current 363 is the same as a magnitude of the desired electrical current 363'. When desired electrical current 363 is changing, however, the magnitude of the desired electrical current 363 may be different than the magnitude of the desired electrical current 363', since inductor 340 resists change in current. As described above, system 300 may be configured to operate without inductor 340 between current sensor 362 and LEDs 350. When inductor 340 is not located between current sensor 362 and LEDs 350, electrical current 363' may be equal to electrical current 363.

Figure 4:
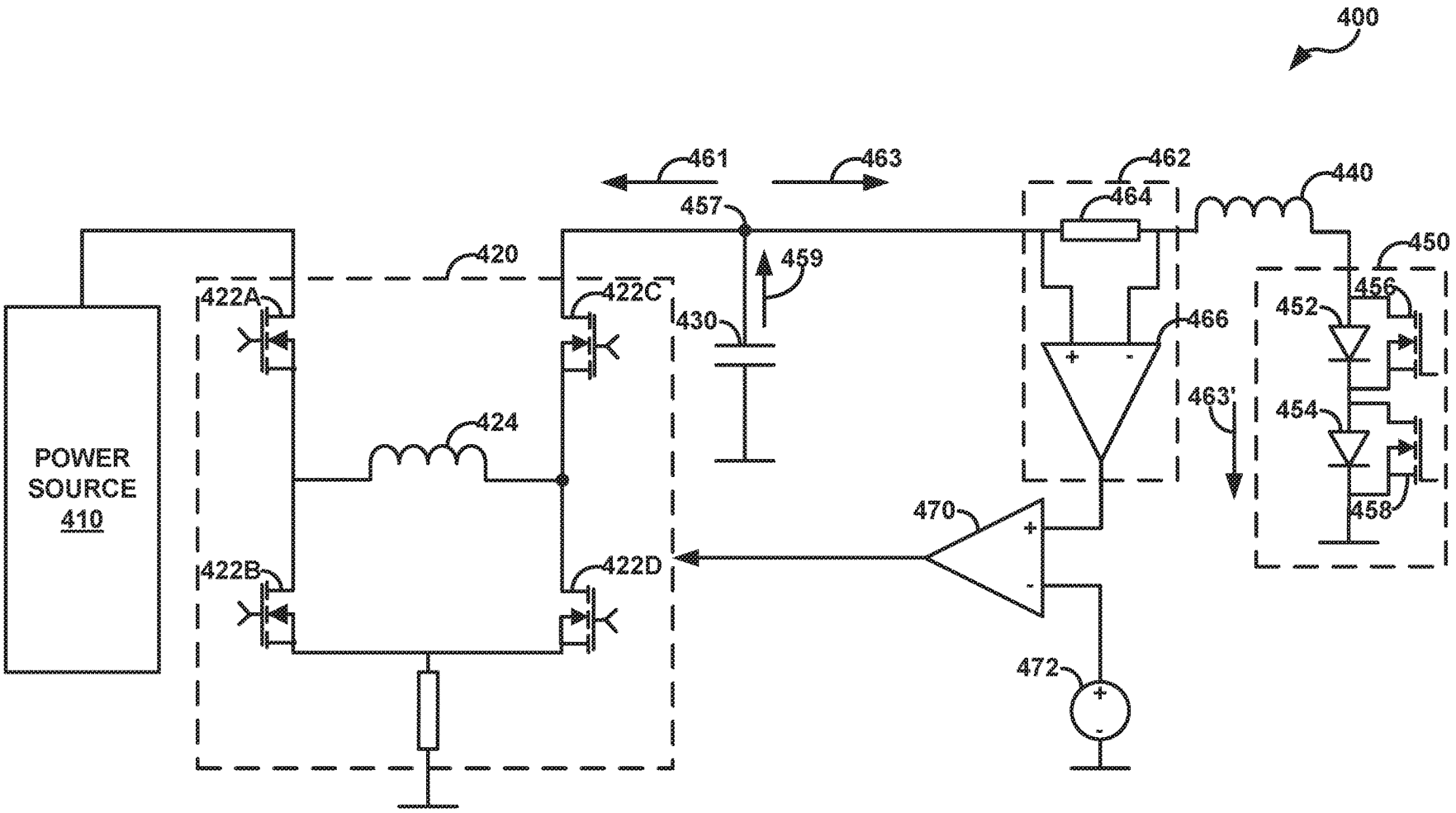
FIG. 4 is a circuit diagram illustrating a system including a circuit for controlling power to a set of LEDs by controlling a power converter, in accordance with one or more techniques of this disclosure.

FIG. 4 is a circuit diagram illustrating a system 400 including a circuit for controlling power to a set of LEDs 450 by controlling a power converter 420, in accordance with one or more techniques of this disclosure. As illustrated in FIG. 4, system 400 includes power source 410, power converter 420, capacitor 430, inductor 440, LEDs 450, current sensor 462, and amplifier 470. Power converter 420 includes switching devices 422A-422D (collectively, "switching devices 422") and inductor 424. LEDs 450 include a first set of LEDs 452, a second set of LEDs 454, a first set of LED switching devices 456, and a second set of LED switching devices 458. Current sensor 462 includes current sensing resistor 464 and current sensing amplifier 466. Amplifier control signal unit 472 may provide an amplifier control signal to amplifier 470. Power source 410 may be an example of power source 110 of FIG. 1. Power converter 420 may be an example of power converter 120 of FIG. 1. Capacitor 430 may be an example of capacitor 130 of FIG. 1. Inductor 440 may be an example of inductor 140 of FIG. 1. LEDs 450 may be an example of LEDs 150 of FIG. 1. Current sensor 462 may be an example of current sensor 162 of FIG. 1. Amplifier 470 may be an example of amplifier 170 of FIG. 1. In some examples, system 400 may be configured to perform one or more techniques described herein without inductor 440.

The system 400 of FIG. 4 may be substantially the same as the system 300 of FIG. 3, except that current sensor 462, amplifier 470, and amplifier control signal unit 472 are placed in a configuration such that node 457 emits desired electrical current 463 which is sensed by current sensor 462, causing amplifier 470 to generate an amplifier signal in order to control power converter 420. System 300 of FIG. 3, on the other hand, includes a current sensor 362 which senses desired electrical current 363, causing amplifier 370 to control a switching device 360, which is separate from power converter 320.

In some examples, power converter 420 charges capacitor 430. When capacitor 430 discharges, capacitor 430 may emit electrical current 459 to node 457. In some examples, when power converter 420 includes an electrical pathway to ground, power converter 420 may sink an unwanted electrical current 461. For example, an electrical pathway may exist between capacitor 430 and ground through switching device 422C and switching device 422D when switching device 422C and switching device 422D are turned on.

Current sensor 462 may be configured to generate a current sensor signal which indicates a magnitude of desired electrical current 463. That is, current sensor 462 may be configured to generate the current sensor signal to indicate the magnitude of the electrical current flowing from node 457 to inductor 440. In some examples, current sensor 462 includes current sensing resistor 464 and current sensing amplifier 466. Ohm's law dictates that a voltage across a resistor is equal to a resistance of the resistor times a magnitude of a current across the resistor (V=I*R). As such, a current across current sensing resistor 464 is equal to a voltage across current sensing resistor 464 divided by a resistance value (in ohms (a)) of current sensing resistor 464. Current sensing amplifier 466, in some cases, may output a current sensor signal correlated with a current across current sensing resistor 464. As such, current sensing amplifier 466 may output the current sensor signal correlated with a current sensed by current sensor 462.

Current sensor 462 outputs the current sensor signal to amplifier 470. Additionally, amplifier 470 receives a control signal from control signal unit 472. In turn, amplifier 470 generates an amplifier signal for output to power converter 420. Additionally, amplifier 470 outputs the amplified signal to power converter 420. In some examples, amplifier 470 may generate the amplifier signal based on a comparison of the current sensor signal to one or more thresholds indicated by the control signal. For example, the control signal may include an upper-bound overshoot current threshold and a lower-bound overshoot current threshold.

When a magnitude of the current sensor signal generated by current sensor 462 increases to the upper-bound overshoot current threshold, amplifier 470 may generate the amplifier signal to create an electrical pathway through power converter 420, thus sinking undesired electrical current 461 to ground and preventing electrical current 459 from damaging LEDs 450 when electrical current 459 represents an overshoot current. By sinking the undesired electrical current 461, amplifier 470 may cause desired electrical current 463 to decrease, thus decreasing the current sensor signal generated by current sensor 462. When the current sensor signal decreases to the lower-bound overshoot current threshold from the upper-bound overshoot current threshold, amplifier 470 may generate the amplifier signal in order to break the electrical pathway through power converter 420. This means that desired electrical current 463 increases, causing the current sensor signal to increase. In some examples, the current sensor signal increases from the lower-bound overshoot current threshold to the upper-bound overshoot current threshold in response to amplifier 470 cutting off the electrical pathway through power converter 420. Responsive to the current sensor signal increasing from the lower-bound overshoot current threshold to the upper-bound overshoot current threshold, amplifier 470 may generate the amplifier signal to once again create the electrical pathway through power converter 420, causing desired electrical current 463 to decrease and preventing electrical current 459 from damaging LEDs 450 when electrical current 459 represents an overshoot current.

Desired electrical current 463' may be substantially the same as desired electrical current 463 except that desired electrical current 463' represents the current on an opposite side of inductor 440 as desired electrical current 463. When inductor 440 is fully charged, a magnitude of the desired electrical current 463 is the same as a magnitude of the desired electrical current 463'. When desired electrical current 463 is changing, however, the magnitude of the desired electrical current 463 may be different than the magnitude of the desired electrical current 463', since inductor 440 resists change in current. As described above, system 400 may be configured to operate without inductor 440 between current sensor 462 and LEDs 450. When inductor 440 is not located between current sensor 462 and LEDs 450, electrical current 463' may be equal to electrical current 463.

Figure 5:
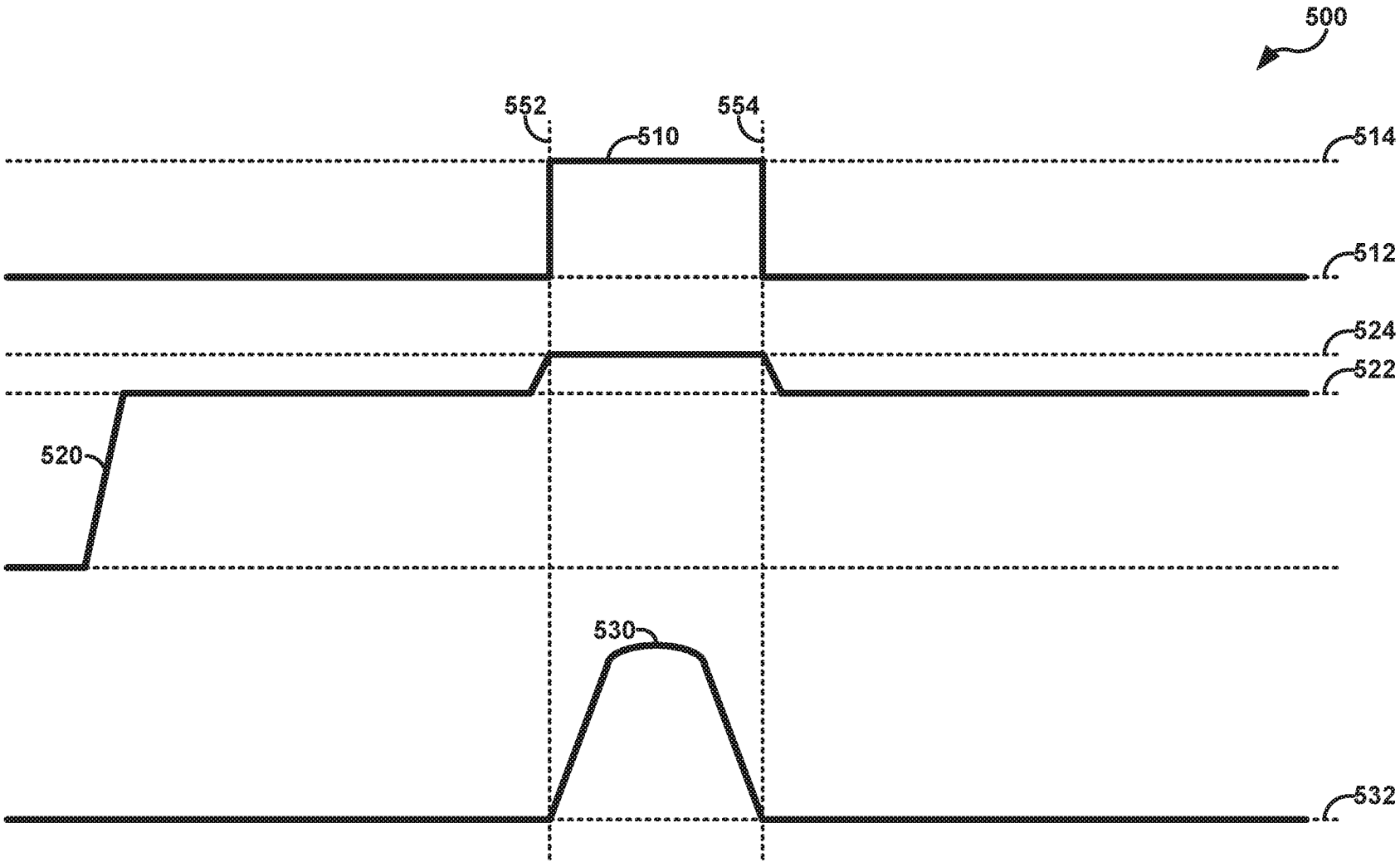
FIG. 5 is a graph illustrating a switching device mode plot, a current sensor signal plot, and an undesired current plot, in accordance with one or more techniques of this disclosure.

FIG. 5 is a graph 500 illustrating a switching device mode plot 510, a current sensor signal plot 520, and an undesired current plot 530, in accordance with one or more techniques of this disclosure. FIG. 5 is described with respect to system 200 of FIG. 2. However, the techniques of FIG. 5 may be performed by different components of system 200 or by additional or alternative systems or devices.

Device mode plot 510 may indicate that switching device 260 is turned off when switching device mode plot 510 is at level 512. Device mode plot 510 may indicate that switching device 260 is turned on when switching device mode plot 510 is at level 514. As seen in FIG. 5, device mode plot 510 transitions from level 512 to level 514 at time 552 and transitions from level 514 to level 512 at time 554. This means that switching device 260 turns on at time 552 and turns off at time 554. In some examples, a control terminal switching device 260 receives an amplifier signal from amplifier 270 which controls whether switching device 260 is turned on or turned off. When switching device 260 is turned on, switching device 260 may sink an undesired electrical current 261, thus preventing an electrical current 259 from damaging LEDs 250.

Current sensor signal plot 520 may, in some examples, may indicate a voltage of the current sensor signal of the current sensor signal generated by current sensor 262. In some examples, amplifier 270 may receive a control signal which includes a current sensor signal threshold 524. In some examples, the current sensor signal threshold is a predetermined percentage above a baseline current sensor signal value 522. As seen in FIG. 5, when current sensor signal plot 520 increases to the current sensor signal threshold 524, amplifier 270 may generate the amplifier signal to turn on switching device 260, thus sinking undesired electrical current 261. When current sensor signal plot 520 decreases from the current sensor signal threshold 524, amplifier 270 may generate the amplifier signal to turn off switching device 260.

Undesired current plot 530 may indicate a magnitude of the undesired electrical current 261 flowing through switching device 260. In some examples, when switching device 260 is turned off, undesired current plot 530 indicates that undesired electrical current 261 is at zero. Level 532 of undesired current plot 530 indicates that the magnitude of undesired electrical current 261 is zero. As seen in FIG. 5, undesired current plot 530 is greater than zero between time 552 and second time 554 when switching device 260 is turned on, meaning that switching device 260 is sinking current.

Figure 6:
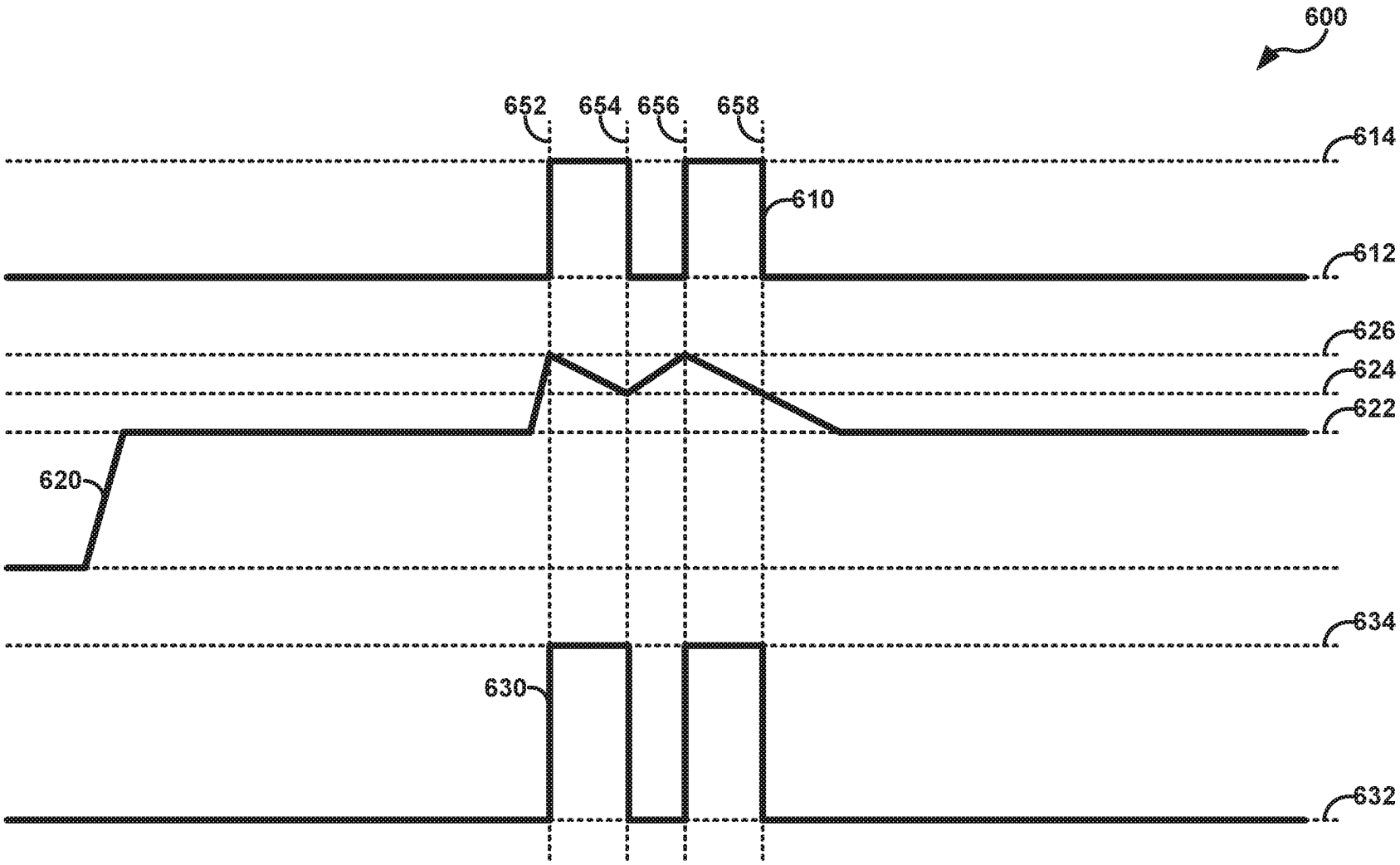
FIG. 6 is a graph illustrating a switching device mode plot, a current sensor signal plot, and an undesired current plot, in accordance with one or more techniques of this disclosure.

FIG. 6 is a graph 600 illustrating a switching device mode plot 610, a current sensor signal plot 620, and an undesired current plot 630, in accordance with one or more techniques of this disclosure. FIG. 6 is described with respect to system 300 of FIG. 3. However, the techniques of FIG. 6 may be performed by different components of system 300 or by additional or alternative systems or devices.

Device mode plot 610 may indicate that switching device 360 is turned off when switching device mode plot 610 is at level 612. Device mode plot 610 may indicate that switching device 360 is turned on when switching device mode plot 610 is at level 612. As seen in FIG. 6, device mode plot 610 transitions from level 612 to level 614 at time 652 and transitions from level 614 to level 612 at time 654. This means that switching device 360 turns on at time 652 and turns off at time 654. Additionally, device mode plot 610 transitions from level 612 to level 614 at time 656 and transitions from level 614 to level 612 at time 658, meaning that switching device 360 turns on at time 656 and turns off at time 658. In some examples, a control terminal switching device 360 receives an amplifier signal from amplifier 370 which controls whether switching device 360 is turned on or turned off. When switching device 360 is turned on, switching device 360 may sink an undesired electrical current 361, thus preventing an electrical current 359 from damaging LEDs 350.

Current sensor signal plot 620 may, in some examples, may indicate a voltage of the current sensor signal of the current sensor signal generated by current sensor 362. In some examples, amplifier 370 may receive a control signal which includes a lower-bound current sensor signal threshold 624 and an upper-bound current sensor signal threshold 626. In some examples, the lower-bound current sensor signal threshold 624 is a first predetermined percentage above a baseline current sensor signal value 622 and the upper-bound current sensor signal threshold 626 is a second predetermined percentage above the baseline current sensor signal value 622. As seen in FIG. 6, when current sensor signal plot 620 increases to the upper-bound current sensor signal threshold 626 at time 652, amplifier 370 may generate the amplifier signal to turn on switching device 360, thus sinking undesired electrical current 361. This may cause current sensor signal plot 620 to decrease from the upper-bound current sensor signal threshold 626 to the lower-bound current sensor signal threshold 624 between time 652 and time 654.

When current sensor signal plot 620 decreases from the upper-bound current sensor signal threshold 626 to the lower-bound current sensor signal threshold 624, amplifier 370 may generate the amplifier signal to turn off switching device 360 at time 654. This may cause the electrical current sensed by current sensor 362 to increase from time 654 to time 656, since switching device 360 does not sink undesired electrical current 361 while switching device 360 is turned off. As seen in FIG. 6, the current sensor signal plot 620 increases from lower-bound current sensor signal threshold 624 to upper-bound current sensor signal threshold 626 between time 654 and time 656. When current sensor signal plot 620 increases to the upper-bound current sensor signal threshold 626 at time 656, amplifier 370 may generate the amplifier signal to turn on switching device 360, thus sinking undesired electrical current 361. This may cause current sensor signal plot 620 to decrease from the upper-bound current sensor signal threshold 626 to the lower-bound current sensor signal threshold 624 between time 656 and time 658. When current sensor signal plot 620 decreases from the upper-bound current sensor signal threshold 626 to the lower-bound current sensor signal threshold 624, amplifier 370 may generate the amplifier signal to turn off switching device 360 at time 658. At time 658, a current overshoot may be over, and current sensor signal plot 620 may continue to decrease to baseline current sensor signal value 622 following time 658.

Undesired current plot 630 may indicate a magnitude of the undesired electrical current 361 flowing through switching device 360. In some examples, when switching device 360 is turned off, undesired current plot 630 indicates that undesired electrical current 361 is at zero. Level 632 of undesired current plot 630 indicates that the magnitude of undesired electrical current 361 is zero. Level 634 of undesired current plot 630 indicates that the magnitude of undesired electrical current 361 is greater than zero. As seen in FIG. 6, undesired current plot 630 is greater than zero between time 652 and time 654 and between time 656 and time 658 when switching device 360 is turned on, meaning that switching device 360 is sinking current. Additionally, undesired current plot 630 is zero before time 652, between time 654 and time 656, and after time 658 when switching device 360 is turned off, meaning that switching device 360 is not sinking current.

Figure 7:
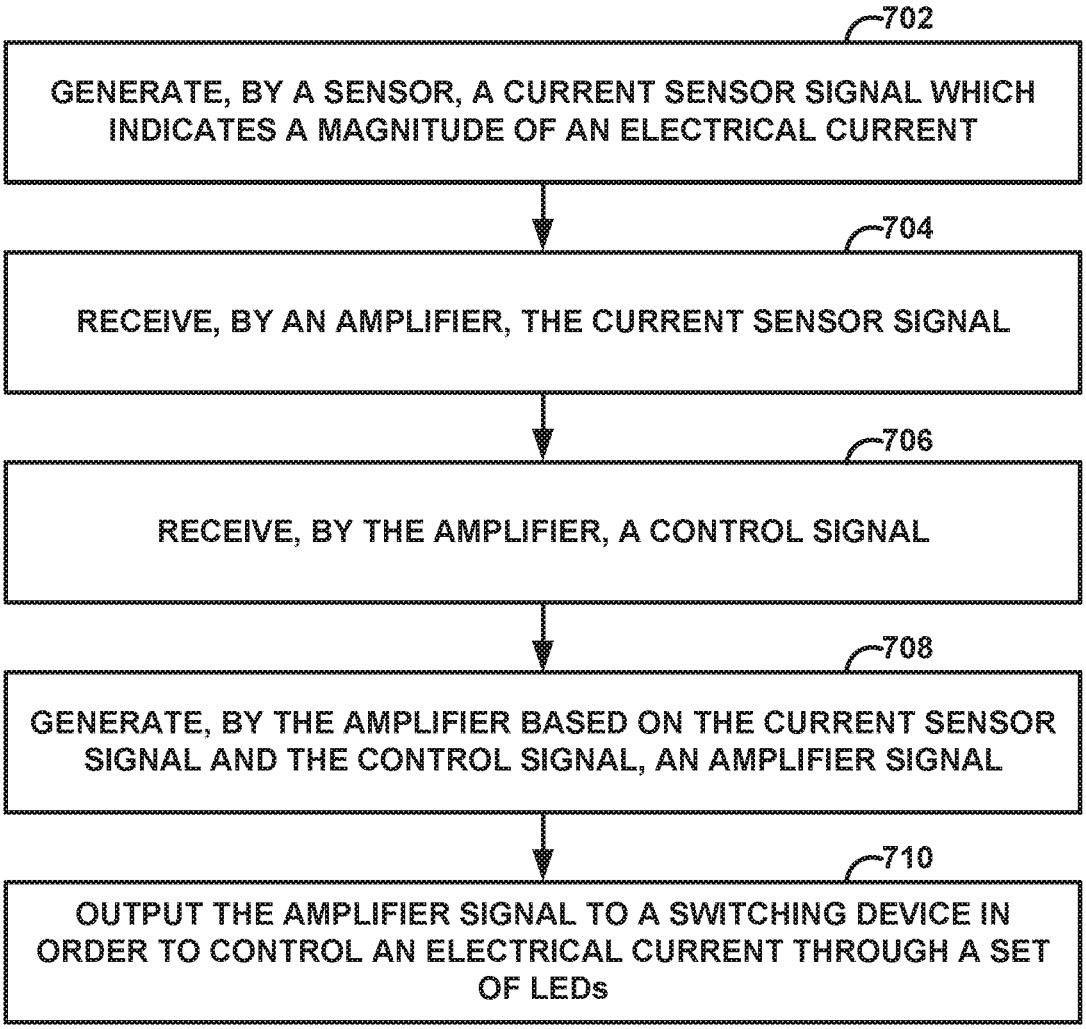
FIG. 7 is a flow diagram illustrating an example operation for controlling a switching device to sink electrical current during an electrical current overshoot, in accordance with one or more techniques of this disclosure.

FIG. 7 is a flow diagram illustrating an example operation for controlling a switching device to sink electrical current during an electrical current overshoot, in accordance with one or more techniques of this disclosure. FIG. 7 is described with respect to system 100 of FIG. 1. However, the techniques of FIG. 7 may be performed by different components of system 100 or by additional or alternative systems.

Current sensor 162 generates a current sensor signal which indicates a magnitude of an electrical current (702). In some examples, the current sensor signal indicates a magnitude of an electrical current, where at least a portion of the electrical current travels to LEDs 150. For example, the current sensor 162 may be configured to detect an electrical current overshoot that is potentially damaging to the LEDs. Amplifier 170 receives the current sensor signal (704) from the current sensor 162. Additionally, amplifier 170 receives a control signal (706). In some examples, the control signal includes one or more current sensor signal thresholds.

Amplifier 170 may compare the current sensor signal with the one or more current sensor signal thresholds in order to control switching device 160. Amplifier 170 is configured to generate the amplifier signal based on the current sensor signal and the control signal (708) and output the amplifier signal to switching device 160 in order to control an electrical current through LEDs 150 (710). For example, when the amplifier signal is at a first level, switching device 160 may turn on and when the amplifier signal is at a second level, switching device 160 may turn off. Power converter 120 and/or capacitor 130 outputs electrical current 159. When switching device 160 is activated, electrical current 159 may be split into the undesired electrical current 161 which flows through switching device 160 to ground and the desired electrical current 163 which flows through LEDs 150 to ground.

During a current overshoot, a magnitude of electrical current 159 may be great enough to damage LEDs 150 if a full burden of electrical current 159 were to reach LEDs 150. By turning on switching device 160, amplifier 170 may split electrical current 159 into undesired electrical current 161 and desired electrical current 163. This may cause undesired electrical current 161, which is a portion of electrical current 159, to flow through switching device 160 rather than flow through 150 and allow desired electrical current 163 to flow through LEDs 150. While switching device 160 is turned on, a magnitude of desired electrical current 163 may be lower than a magnitude of electrical current 159 such that desired electrical current 163 does not cause damage to LEDs 150. In other words, by preventing undesired electrical current 161 from reaching LEDs 150, amplifier 170 may prevent a full force of electrical current 159 from damaging LEDs 160 during a current overshoot.

The techniques described in this disclosure may be implemented, at least in part, in hardware, software, firmware, or any combination thereof. For example, various aspects of the described techniques may be implemented within one or more processors, including one or more microprocessors, digital signal processors (DSPs), application specific integrated circuits (ASICs), field-programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Such hardware, software, and firmware may be implemented within the same device or within separate devices to support the various techniques described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware, firmware, or software components. Rather, functionality associated with one or more modules or units may be performed by separate hardware, firmware, or software components, or integrated within common or separate hardware, firmware, or software components.

The following numbered examples demonstrate one or more aspects of the disclosure.

Example 1. A circuit configured to control power delivered to a string of light-emitting diodes (LEDs), the circuit including a power converter configured to generate an electrical current, a switching device, and a sensor. The sensor is configured to compare a magnitude of the electrical current to a threshold. In response to the magnitude exceeding the threshold, the sensor is configured to cause the switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

Example 2. The circuit of example 1, wherein when the switching device is turned on, the undesired electrical current flows across the switching device without flowing through the string of LEDs.

Example 3. The circuit of any of examples 1-2, wherein when the switching device is turned off, the electrical current generated by the power converter corresponds to the desired electrical current that flows to the string of LEDs to drive the LEDs without any of the undesired electrical current flowing through the switching device.

Example 4. The circuit of any of examples 1-3, wherein the sensor is configured to generate a first electrical signal to indicate a magnitude of at least a portion of the electrical current, and wherein the circuit further includes an amplifier configured to: receive the first electrical signal; receive a second electrical signal; generate, based on the first electrical signal and the second electrical signal, a third electrical signal; and output the third electrical signal to the switching device in order to control whether the switching device is turned on or turned off.

Example 5. The circuit of any of examples 1-4, wherein the amplifier is configured to generate the first electrical signal to indicate the magnitude of the desired electrical current which flows from the power source to the string of LEDs, wherein the second electrical signal includes a lower-bound voltage value and an upper-bound voltage value, and wherein the amplifier is configured to: generate the third electrical signal in order to turn on the switching device when the first electrical signal increases to the upper-bound voltage value, causing the first electrical signal to decrease from the upper-bound voltage value; and generate the third electrical signal in order to turn off the switching device when the first electrical signal decreases to the lower-bound voltage value.

Example 6. The circuit of any of examples 1-5, wherein the sensor is configured to generate the first electrical signal to indicate the magnitude of electrical current generated by the power converter, wherein the second electrical signal includes a maximum voltage value, and wherein the amplifier is configured to: generate the third electrical signal in order to turn on the switching device when the first voltage value increases to the maximum voltage value; and generate the third electrical signal in order to turn off the switching device when the first voltage value decreases from the maximum voltage value.

Example 7. The circuit of any of examples 1-6, wherein the amplifier is configured to receive the second electrical signal from the undesired electrical current which flows across the switching device.

Example 8. The circuit of any of examples 1-7, wherein the power converter includes the switching device, wherein to output the third electrical signal to the switching device in order to control whether the switching device is turned on or turned off, the amplifier is configured to output the third electrical signal to the power converter, preventing the magnitude of the desired electrical current from exceeding the threshold.

Example 9. The circuit of any of examples 1-8, wherein by outputting the third electrical signal to the power converter, the amplifier is configured to cause the power converter to change a duty cycle of the switching device in order to prevent the magnitude of the desired electrical current from exceeding the threshold.

Example 10. The circuit of any of examples 1-9, further including a controller configured to: output a control signal in order to short a path across a first set of LEDs of the string of LEDs, causing the first set of LEDs to turn off while a second set of LEDs of the string of LEDs remain turned on, wherein creating the short path across the first set of LEDs decreases a resistance of the string of LEDs, thus increasing the magnitude of the desired electrical current flowing to the string of LEDs.

Example 11. The circuit of any of examples 1-10, wherein the controller outputs the control signal in order to short the path across the first set of LEDs in response to receiving an instruction to toggle the string of LEDs from a high beam (HB) mode to a low beam (LB) mode.

Example 12. A method for controlling power delivered to a string of light-emitting diodes (LEDs), the method including generating, by a power converter, an electrical current and comparing, by a sensor, a magnitude of the electrical current to a threshold. In response to the magnitude exceeding the threshold, the method further includes causing, by the sensor, a switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

Example 13. The method of example 12, wherein when the switching device is turned on, the undesired electrical current flows across the switching device without flowing through the string of LEDs.

Example 14. The method of any of examples 12-13, wherein when the switching device is turned off, the electrical current generated by the power converter corresponds to the desired electrical current that flows to the string of LEDs to drive the LEDs without any of the undesired electrical current flowing through the switching device.

Example 15. The method of any of examples 12-14, further including: generating, by the sensor, a first electrical signal to indicate a magnitude of at least a portion of the electrical current; receiving, by an amplifier, the first electrical signal; receiving, by the amplifier, a second electrical signal; generating, by the amplifier based on the first electrical signal and the second electrical signal, a third electrical signal; and outputting, by the amplifier, the third electrical signal to the switching device in order to control whether the switching device is turned on or turned off.

Example 16. The method of any of examples 12-15, further including: generating, by the amplifier, the first electrical signal to indicate the magnitude of the desired electrical current which flows from the power source to the string of LEDs, wherein the second electrical signal includes a lower-bound voltage value and an upper-bound voltage value; generating, by the amplifier, the third electrical signal in order to turn on the switching device when the first electrical signal increases to the upper-bound voltage value, causing the first electrical signal to decrease from the upper-bound voltage value; and generating, by the amplifier, the third electrical signal in order to turn off the switching device when the first electrical signal decreases to the lower-bound voltage value.

Example 17. The method of any of examples 12-16, further including: generating, by the sensor, the first electrical signal to indicate the magnitude of electrical current generated by the power converter, wherein the second electrical signal includes a maximum voltage value; generating, by the amplifier, the third electrical signal in order to turn on the switching device when the first voltage value increases to the maximum voltage value; and generating, by the amplifier, the third electrical signal in order to turn off the switching device when the first voltage value decreases from the maximum voltage value.

Example 18. The method of any of examples 12-17, further including receiving, by the amplifier, the second electrical signal from the undesired electrical current which flows across the switching device.

Example 19. The method of any of examples 12-18, wherein the power converter includes the switching device, wherein outputting the third electrical signal to the switching device in order to control whether the switching device is turned on or turned off includes outputting, by the amplifier, the third electrical signal to the power converter, preventing the magnitude of the desired electrical current from exceeding the threshold.

Example 20. The method of any of examples 12-19, wherein by outputting the third electrical signal to the power converter, the amplifier is configured to cause the power converter to change a duty cycle of the switching device in order to prevent the magnitude of the desired electrical current from exceeding the threshold.

Example 21. The method of any of examples 12-20, further including: outputting, by a controller, a control signal in order to short a path across a first set of LEDs of the string of LEDs, causing the first set of LEDs to turn off while a second set of LEDs of the string of LEDs remain turned on, wherein creating the short path across the first set of LEDs decreases a resistance of the string of LEDs, thus increasing the magnitude of the desired electrical current flowing to the string of LEDs.

Example 22. The method of any of examples 12-21, wherein the controller outputs the control signal in order to short the path across the first set of LEDs in response to receiving an instruction to toggle the string of LEDs from a high beam (HB) mode to a low beam (LB) mode.

Example 23. A system including: a string of light-emitting diodes (LEDs); a power converter configured to generate an electrical current; a switching device; and a sensor. The sensor is configured to compare a magnitude of the electrical current to a threshold. In response to the magnitude exceeding the threshold, the sensor is configured to cause the switching device to turn on in order to sink a portion of the electrical current to prevent the magnitude of the electrical current from exceeding the threshold. When the switching device is turned on, the electrical current is divided into an undesired electrical current that flows across the switching device and a desired electrical current that flows to the string of LEDs.

Various examples of the disclosure have been described. These and other examples are within the scope of the following claims.

What is claimed is:

1. A circuit configured to control power delivered to a string of light-emitting diodes (LEDs), the circuit comprising:

a power converter configured to generate an electrical current;

a switching device; and a sensor configured to:

generate an electrical signal to indicate a magnitude of a first portion of the electrical current, wherein at least some of the first portion of the electrical current is delivered to the string of LEDs;

compare the magnitude to a first portion threshold; and in response to the magnitude exceeding the first portion threshold, cause the switching device to turn on in order to sink a second portion of the electrical current, wherein when the switching device is turned on, the electrical current is split into an undesired electrical current that flows across the switching device and a desired electrical current that flows to the string of LEDs, wherein the second portion of the electrical current comprises the undesired electrical current, wherein a third portion of the electrical current comprises the desired electrical current, and wherein causing the switching device to turn on in order to sink the second portion of the electrical current prevents a magnitude of the third portion of the electrical current from exceeding a third portion threshold.

2. The circuit of claim 1, wherein when the switching device is turned on, the undesired electrical current flows across the switching device without flowing through the string of LEDs.

3. The circuit of claim 1, wherein when the switching device is turned off, the first portion of the electrical current generated by the power converter corresponds to the desired electrical current that flows to the string of LEDs to drive the LEDs without any of the undesired electrical current flowing through the switching device.

4. The circuit of claim 1, wherein the sensor is configured to generate a first electrical signal to indicate the magnitude of the first portion of the electrical current, and wherein the circuit further comprises an amplifier configured to:

receive the first electrical signal;

receive a second electrical signal;

generate, based on the first electrical signal and the second electrical signal, a third electrical signal; and output the third electrical signal to the switching device in order to control whether the switching device is turned on or turned off.

5. The circuit of claim 4, wherein the amplifier is configured to generate the first third electrical signal, wherein the second electrical signal includes a lower-bound voltage value and an upper-bound voltage value, and wherein the amplifier is configured to:

generate the third electrical signal in order to turn on the switching device when the first electrical signal increases to the upper-bound voltage value, causing the first electrical signal to decrease from the upper-bound voltage value; and generate the third electrical signal in order to turn off the switching device when the first electrical signal decreases to the lower-bound voltage value.

6. The circuit of claim 4, wherein the second electrical signal includes a maximum voltage value, and wherein the amplifier is configured to:

generate the third electrical signal in order to turn on the switching device when the first voltage value increases to the maximum voltage value; and generate the third electrical signal in order to turn off the switching device when the first voltage value decreases from the maximum voltage value.

7. The circuit of claim 6, wherein the amplifier is configured to receive the second electrical signal from the undesired electrical current which flows across the switching device.

8. The circuit of claim 4, wherein the power converter includes the switching device, wherein to output the third electrical signal to the switching device in order to control whether the switching device is turned on or turned off, the amplifier is configured to output the third electrical signal to the power converter, preventing the magnitude of the third portion of the electrical current from exceeding the third portion threshold.

9. The circuit of claim 8, wherein by outputting the third electrical signal to the power converter, the amplifier is configured to cause the power converter to change a duty cycle of the switching device in order to prevent the magnitude of the third portion of the electrical current from exceeding the third portion threshold.

10. The circuit of claim 1, further comprising a controller configured to:

output a control signal in order to short a path across a first set of LEDs of the string of LEDs, causing the first set of LEDs to turn off while a second set of LEDs of the string of LEDs remain turned on, wherein creating the short path across the first set of LEDs decreases a resistance of the string of LEDs, thus increasing the magnitude of the desired electrical current flowing to the string of LEDs.

11. The circuit of claim 10, wherein the controller outputs the control signal in order to short the path across the first set of LEDs in response to receiving an instruction to toggle the string of LEDs from a high beam (HB) mode to a low beam (LB) mode.

12. A method for controlling power delivered to a string of light-emitting diodes (LEDs), the method comprising:

generating, by a power converter, an electrical current;

generating, by a sensor, an electrical signal to indicate a magnitude of a first portion of the electrical current, wherein at least some of the first portion of the electrical current is delivered to the string of LEDs;

comparing, by the sensor, the magnitude to a first portion threshold; and in response to the magnitude exceeding the first portion threshold, causing, by the sensor, a switching device to turn on in order to sink a second portion of the electrical current, wherein when the switching device is turned on, the electrical current is split into an undesired electrical current tint flows across the switching device and a desired electrical current that flows to the string of LEDs, wherein the second portion of the electrical current comprises the undesired electrical current, wherein a third portion of the electrical current comprises the desired electrical current, and wherein causing the switching device to turn on in order to sink the second portion of the electrical current prevents a magnitude of the third portion of the electrical current From exceeding a third portion threshold.

13. The method of claim 12, wherein when the switching device is turned on, the undesired electrical current flows across the switching device without flowing through the string of LEDs.

14. The method of claim 12, wherein when the switching device is turned off, the first portion of the electrical current generated by the power converter corresponds to the desired electrical current that flows to the string of LEDs to drive the LEDs without any of the undesired electrical current flowing through the switching device.

15. The method of claim 12, further comprising:

generating, by the sensor, a first electrical signal to indicate the magnitude of the first portion of the electrical current;

receiving, by an amplifier, the first electrical signal;

receiving, by the amplifier, a second electrical signal;

generating, by the amplifier based on the first electrical signal and the second electrical signal, a third electrical signal; and outputting, by the amplifier, the third electrical signal to the switching device in order to control whether the switching device is turned on or turned off.

16. The method of claim 15, further comprising:

generating, by the amplifier, the first third electrical signal, wherein the second electrical signal includes a lower-bound voltage value and an upper-bound voltage value;

generating, by the amplifier, the third electrical signal in order to turn on the switching device when the first electrical signal increases to the upper-bound voltage value, causing the first electrical signal to decrease from the upper-bound voltage value; and generating, by the amplifier, the third electrical signal in order to turn off the switching device when the first electrical signal decreases to the lower-bound voltage value.

17. The method of claim 15, wherein the second electrical signal includes a maximum voltage value, and wherein the method further comprises:

generating, by the amplifier, the third electrical signal in order to turn on the switching device when the first voltage value increases to the maximum voltage value; and generating, by the amplifier, the third electrical signal in order to turn off the switching device when the first voltage value decreases from the maximum voltage value.

18. The method of claim 17, further comprising receiving, by the amplifier, the second electrical signal from the undesired electrical current which flows across the switching device.

19. The method of claim 15, wherein the power converter comprises includes the switching device, wherein outputting the third electrical signal to the switching device in order to control whether the switching device is turned on or turned off comprises outputting, by the amplifier, the third electrical signal to the power converter, preventing the magnitude of the third portion of the electrical current from exceeding the third portion threshold.

20. The method of claim 19, wherein by outputting the third electrical signal to the power converter, the amplifier is configured to cause the power converter to change a duty cycle of the switching device in order to prevent the magnitude of the third portion of the electrical current from exceeding the third portion threshold.

21. The method of claim 12, further comprising:

outputting, by a controller, a control signal in order to short a path across a first set of LEDs of the string of LEDs, causing the first set of LEDs to turn off while a second set of LEDs of the string of LEDs remain turned on, wherein creating the short path across the first set of LEDs decreases a resistance of the string of LEDs, thus increasing the magnitude of the desired electrical current flowing to the string of LEDs.

22. The method of claim 21, wherein the controller outputs the control signal in order to short the path across the first set of LEDs in response to receiving an instruction to toggle the string of LEDs from a high beam (FIB) mode to a low beam (LB) mode.

23. A system comprising:

a string of light-emitting diodes (LEDs);

a power converter configured to generate an electrical current;

a switching device; and a sensor configured to:

generate an electrical signal to indicate a magnitude of a first portion of the electrical current, wherein at least some of the first portion of the electrical current is delivered to the string of LEDs:

compare the magnitude to a first portion threshold; and in response to the magnitude exceeding the first portion threshold, cause the switching device to turn on in order to sink a second portion of the electrical current, wherein when the switching device is turned on, the electrical current is split into an undesired electrical current that flows across the switching device and a desired electrical current that flows to the string of LEDs, wherein the second portion of the electrical current comprises the undesired electrical current, wherein a third portion of the electrical current comprises the desired electrical current, and wherein causing the switching device to turn on in order to sink the second portion of the electrical current prevents a magnitude of the third portion of the electrical current from exceeding a third portion threshold.

* * * * *